US011147354B2

(12) United States Patent
Wathne

(10) Patent No.: US 11,147,354 B2
(45) Date of Patent: Oct. 19, 2021

(54) SAMPLE HOLDER

(71) Applicant: TSB LIMITED, New York, NY (US)

(72) Inventor: Soffia G. Wathne, Rye, NY (US)

(73) Assignee: TSB LIMITED, New York, NY (US)

( * ) Notice: Subject to any disclaimer, the term of this patent is extended or adjusted under 35 U.S.C. 154(b) by 173 days.

(21) Appl. No.: 16/553,643

(22) Filed: Aug. 28, 2019

(65) Prior Publication Data

US 2021/0059381 A1 Mar. 4, 2021

(51) Int. Cl.

| | |
|---|---|
| ***A45D 34/02*** | (2006.01) |
| ***A45D 40/00*** | (2006.01) |
| ***B65D 85/30*** | (2006.01) |
| ***B65D 85/20*** | (2006.01) |
| ***B65D 81/02*** | (2006.01) |

(52) U.S. Cl.

CPC ..... *A45D 34/02* (2013.01); *A45D 40/0087* (2013.01); *B65D 81/022* (2013.01); *B65D 85/20* (2013.01); *B65D 85/307* (2013.01)

(58) Field of Classification Search

CPC ..... A45D 34/02; A45D 34/00; A45D 34/046; A45D 40/267; A45D 40/34; A45D 40/047; A45D 40/268; A45D 40/0087; B65D 85/30; B65D 85/307; B65D 85/38; B65D 85/1018; B65D 85/20; B65D 85/22; B65D 85/24; B65D 85/28; B65D 81/02; B65D 81/022; B01L 9/06; B01L 9/54

USPC ..... 401/126–130, 121, 122; 220/23.88, 220/23.89; 206/248, 385, 446

See application file for complete search history.

(56) References Cited

U.S. PATENT DOCUMENTS 4,403,624 A * 9/1983 Montgomery ..... A45D 40/267 132/218
7,311,201 B2 * 12/2007 Lo ..... B65D 15/04 206/427
9,538,829 B2 * 1/2017 Chung ..... A45D 34/046

* cited by examiner

*Primary Examiner* — David J Walczak
(74) *Attorney, Agent, or Firm* — Katten Muchin Rosenman LLP

(57) ABSTRACT

The sample holder is configured to releasably and securely hold fragrance sample bottles therein. The sample holder generally comprises a body and a cap. The cap preferably mates with the body via a friction fit or threaded connection. The body comprises an interior cavity having one or more retaining structures for releasably retaining the bottles within the cavity. A length of the cavity is also adjustable to accommodate sample bottles of different lengths. An exterior of the body may comprise a pattern, material, or fabric to enhance the aesthetics of the sample holder.

11 Claims, 8 Drawing Sheets

SAMPLE HOLDER

FIELD OF THE INVENTION

The present invention discloses a sample holder for use in holding and transporting fragrance samples placed therein. More particularly, the present invention provides a fragrance sample holder which releasably holds a fragrance sample therein and provides a more pleasant and user-friend external appearance.

BACKGROUND

In department stores and other retail locations, fragrance samples are often distributed in small cylindrical spray or applicator bottles. Each bottle contains a small fragrance sample, such as cologne or perfume, which are distributed for free or provided along with purchases. The bottles are intentionally cheap and small and can be hard to operate by a grown adult. In addition, the bottles are similar in appearance, unadorned, and hard to differentiate. Also, there are more than a dozen different shapes and sizes of these bottles which is often not apparent until many different bottles have been collected by a customer.

Because these bottles are small and difficult to use, many are lost or go unused. Therefore, a need exists for a fragrance sample holder which makes the bottles easier to use while providing a convenient and more attractive carrying structure. Further, the fragrance sample holder preferably also has a cap to prevent accidental discharge of the fragrance contained in the bottle.

SUMMARY

Disclosed herein is a sample holder configured to releasably and securely hold fragrance sample bottles therein. The sample holder generally comprises a body and a cap. The cap preferably mates with the body via a friction fit or threaded connection. The body comprises an interior cavity having one or more retaining structures for releasably retaining the bottles within the cavity. A length of the cavity is also adjustable to accommodate sample bottles of different lengths. An exterior of the body may comprise a pattern, material, or fabric to enhance the aesthetics of the sample holder.

DETAILED DESCRIPTION

Figure 1:
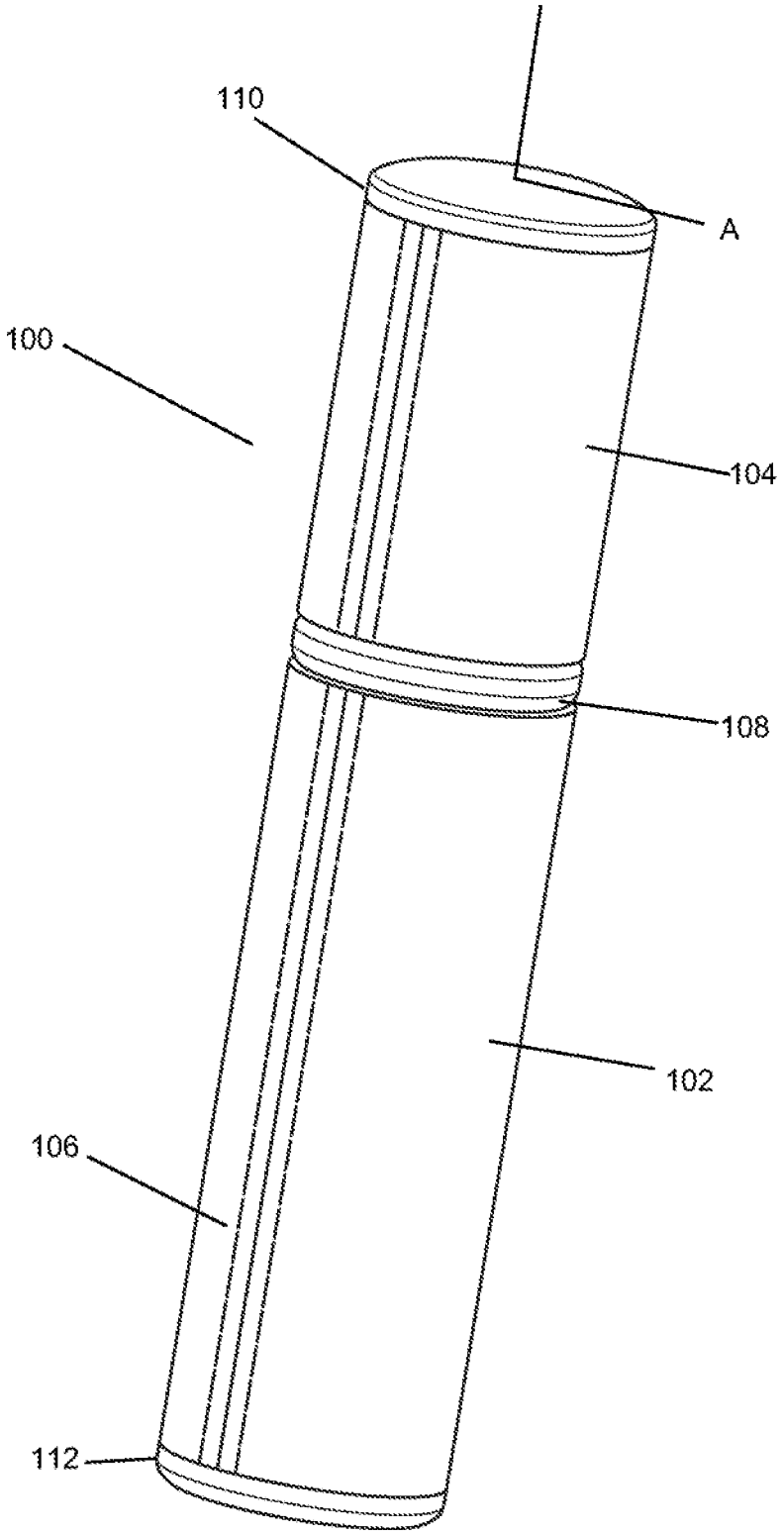
FIG. 1 depicts a front perspective view of the sample holder.
Figure 2:
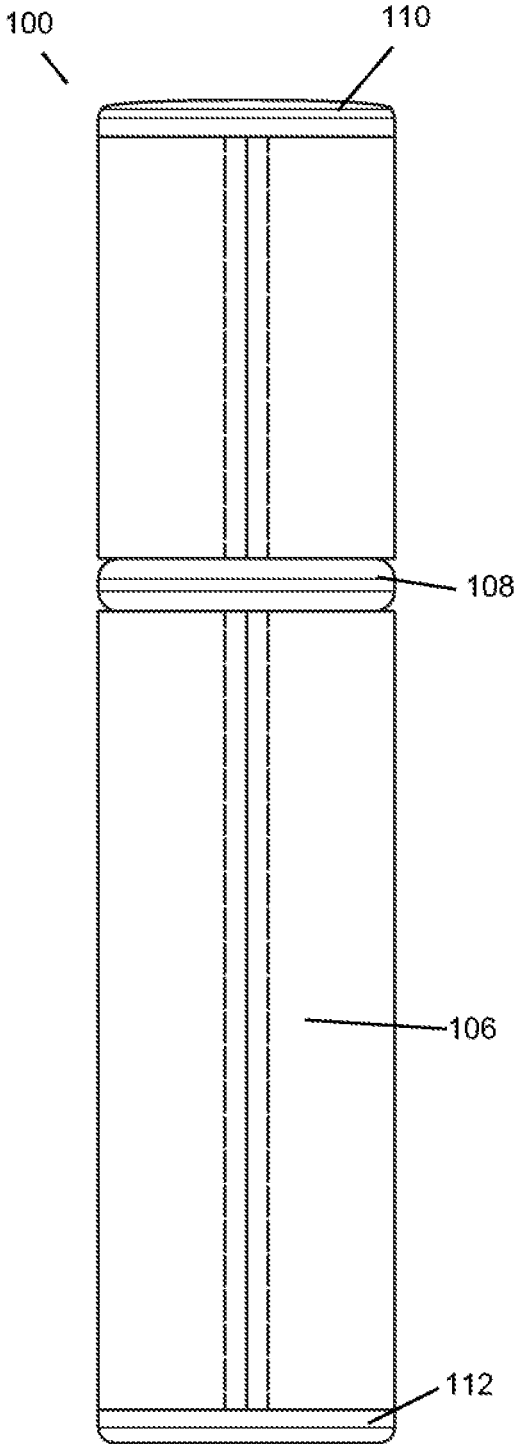
FIG. 2 depicts a front view of the sample holder.
Figure 3:
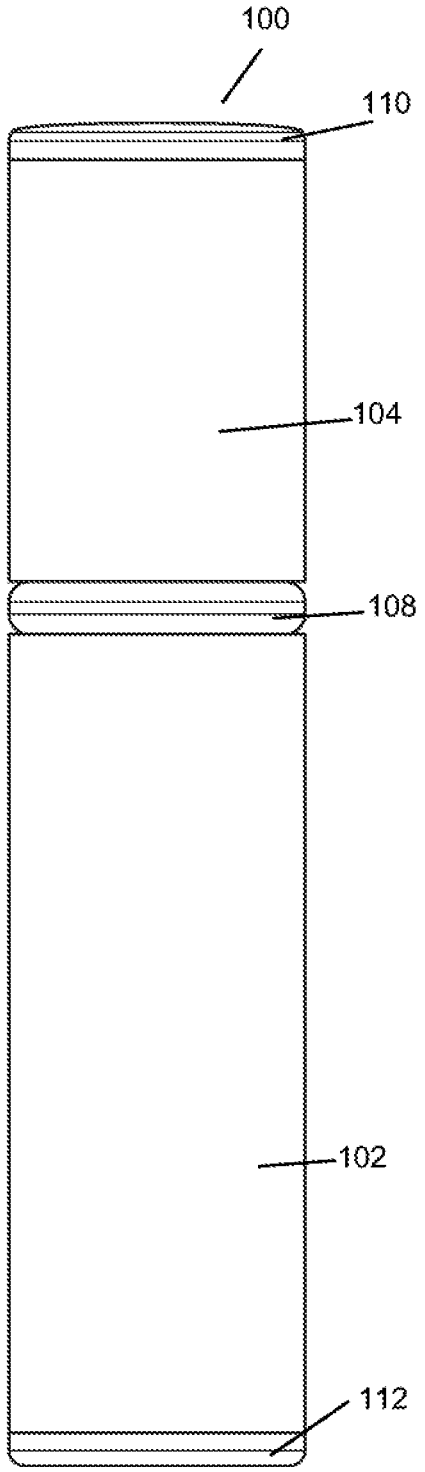
FIG. 3 depicts a rear view of the sample holder.
Figure 4:
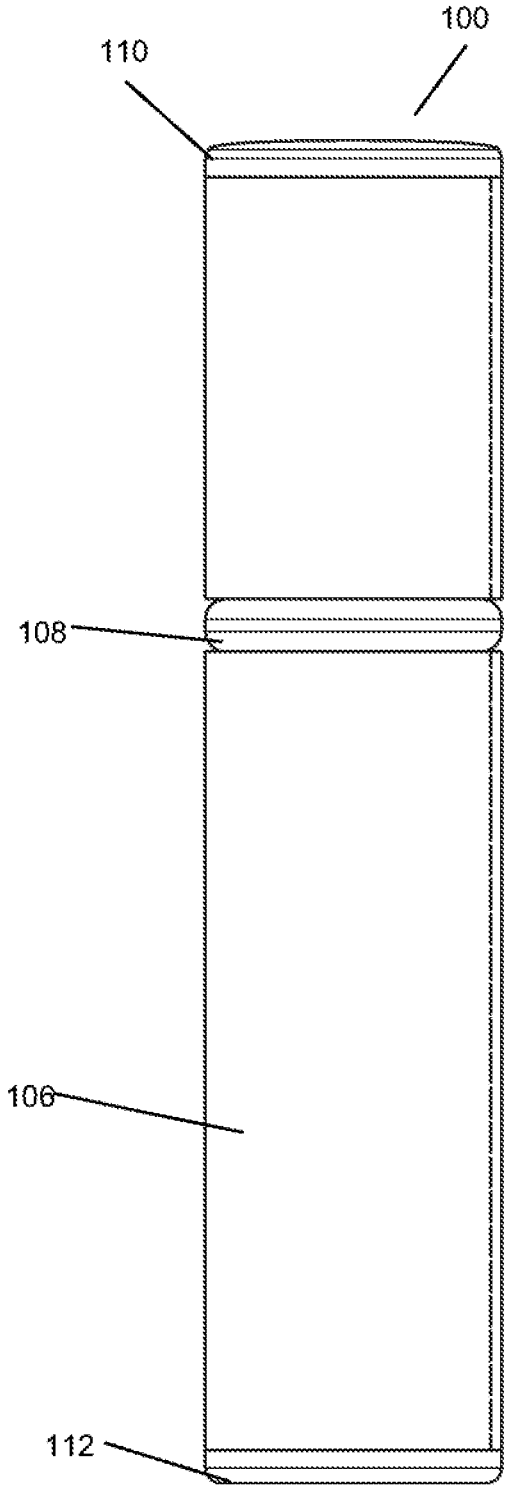
FIG. 4 depicts a left side view of the sample holder.
Figure 5:
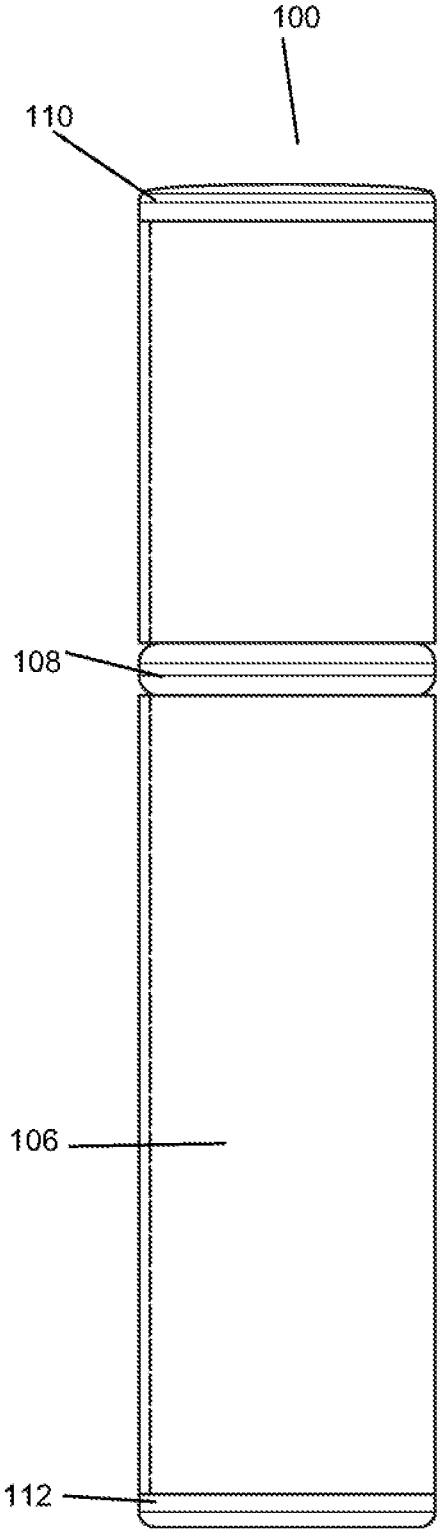
FIG. 5 depicts a right side view of the sample holder.
Figure 6:
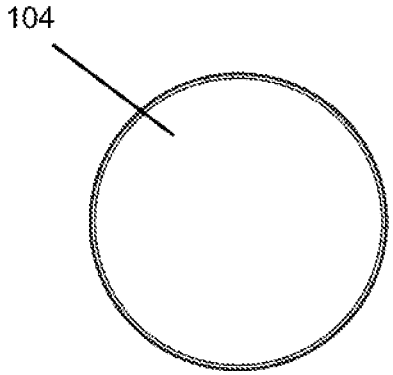
FIG. 6 depicts a top view of the sample holder.
Figure 7:
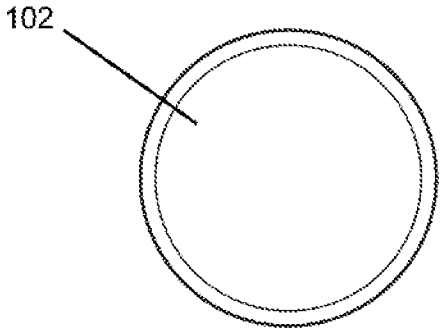
FIG. 7 depicts a bottom view of the sample holder.

Referring first to FIG. 1, depicted is an exterior perspective view of sample holder 100. Sample holder 100 generally comprises body 102, configured to hold the sample bottle, and cap 104 which is used to cover the top of the sample bottle to prevent accidental discharge or dislodgement of the sample bottle. Sample holder 100 is preferably cylindrical in shape and has an overall length of 11-12 cm. However, other shapes, such as oval, rectangular, and square may also be employed as well as the body 102 can accommodate the internal holder which will be described later.

Body 102 and/or cap 104 may be covered with an external fabric or textile, such as fabric or leather to give sample holder 100 a pleasant aesthetic appearance. In the depicted embodiment, body 102 and cap 104 are wrapped by covering 106 and joined at a seam. Cover 106 may be made of leather, fabric, synthetic material, etc. In other embodiments, body 102 or cap 104 may be left bare to show their composite material such as metal or plastic. Body or cap 104 may also be covered with branding or other text. In some embodiments, body 102 additionally comprises band 108 which visually separates body 102 from cap 108.

Cap 104 preferably has an outer diameter of 2-2.5 cm.

FIGS. 2-7 are provided to depict additional views of sample holder 100 so that the complete external design of the depicted embodiment is viewable. As better shown in FIGS. 2-5, sample holder 100 may additionally comprise top band 110 and bottom band 112 which mimic the design of band 108 an provide a more symmetric appearance to sample holder 100.

Body 102 and cap 104 may be formed from the same or different materials. For example, cap 104 may be formed from a lightweight metal, such as aluminum while body 102 is formed from a hard plastic.

Figure 8:
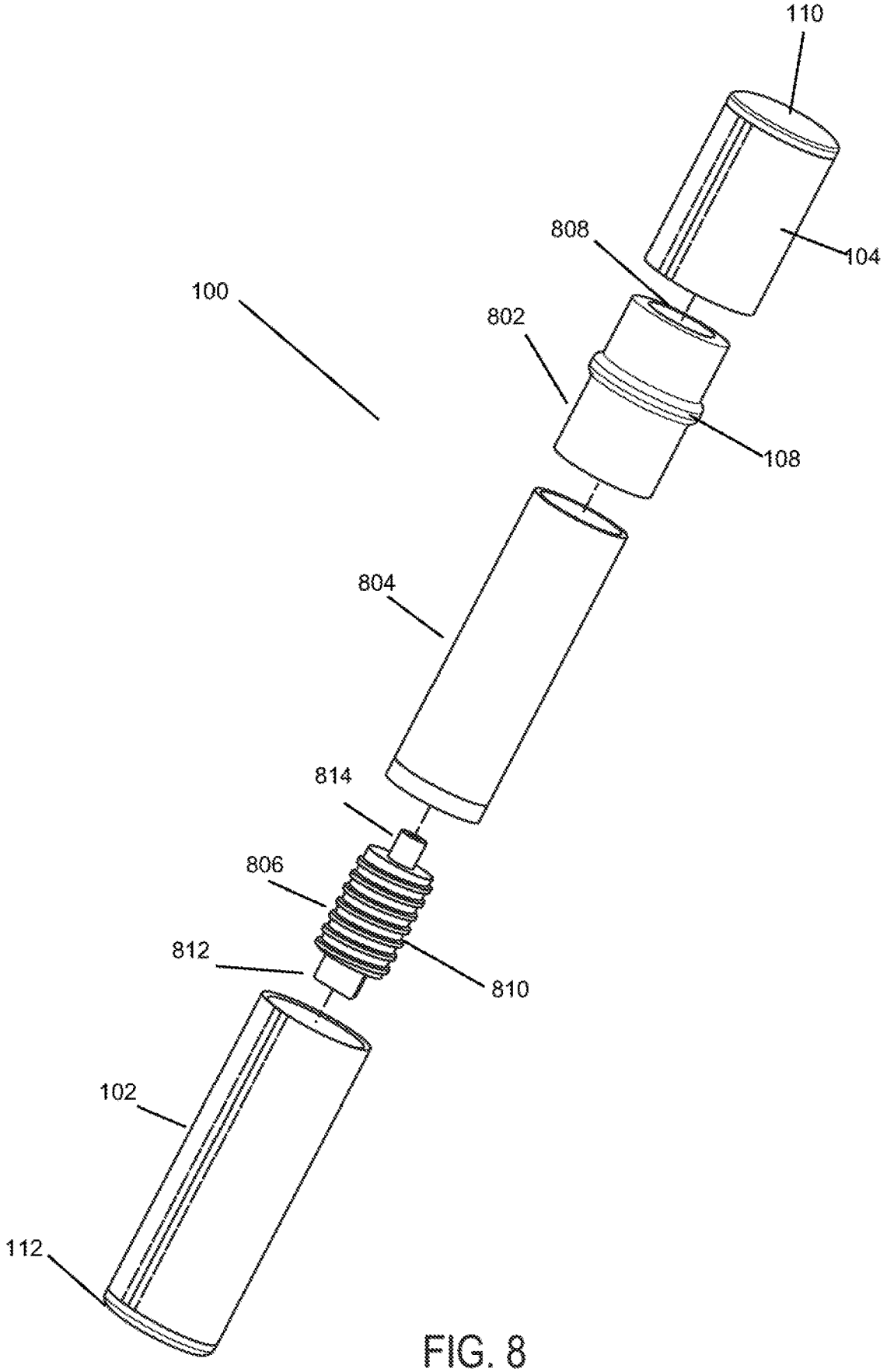
FIG. 8 depicts an exploded view of the sample holder showing all components.

FIG. 8 depicts an exploded view of sample holder 100 showing all internal and external components simultaneously. The external features of body 102 and cap 104 have already been described with respect to FIGS. 1-7. Sample holder 100 additionally comprises cap retainer 802, cylindrical tube 804, and threaded seat 806. When joined together, these elements accommodate the sample bottle placed therein as will be described. Cap retainer 802 is slightly wider in diameter than cylindrical tube 804 so that it can entirely be slid over cylindrical tube 804. Cap retainer 802 may be retained on cylindrical tube 804 by a friction fit or an adhesive may also be utilized. In some embodiments, cap retainer 802 and cylindrical tube 804 can also be integrally formed as a single piece, for example using extrusion. However, it is preferable that cap retainer 802 is formed from an aesthetically pleasing material since it is visible when cap 104 is removed from cap retainer 802. For example, cap retainer 802 may be formed from a light metal, such as aluminum, or a plastic covered with a metallic paint or finish.

The top portion of cap retainer 802 comprises holder opening 808 which has a smaller diameter than the remainder of cap retainer 802 or cylindrical tube 804. The top portion of cap retainer 802 preferably has an outer diameter of 1.5-2 cm. Holder opening 808 provides two important functions. First, the smaller diameter of holder opening 808 prevents cylindrical tube 804 from being inserted past holder opening 808 during assembly. Further, holder opening 808 is specifically sized such that it is only slightly larger than the largest diameter sample bottles currently. Holder opening 808 is preferably 1-1.5 cm in diameter. This helps to prevent the tip of the inserted sample bottle, which sits slightly above holder opening 808, from wiggling during use and leading to a better user experience.

Cap retainer 802 also comprises band 108, which has a diameter greater than or equal to an inner diameter of the body 102, around it periphery. Band 108 limits how far cap retainer 802 and cylindrical tube 804 can be inserted into body 102. Also, because cylindrical tube 804 must be removable in order to adjust sample holder 100, band 108 also provides a good gripping surface, allowing a user to easily remove cap retainer 802 and cylindrical tube 804 from body 102.

The outer diameter of cap retainer 802 below band 108 is sized for a friction fit with the interior of body 102. However, like cap 104, it should be apparent that this portion of cap retainer 802 could also comprise threads which mate with grooves on an interior surface of body 102.

The interior of cylindrical tube 804, which holds and retains the sample bottles, will be described later. Threaded seat 806 comprises a plurality of threads 810 which mate with grooves internal to the bottom of cylindrical tube 804. A bottom of threaded seat 806 comprises handle 812 which allows a user to unscrew/screw threaded seat 806 into cylindrical tube 804. By adjusting threaded seat 806 using handle 812, a user can adjust seat 814 which limits how far a sample bottle can be inserted into cylindrical tube 804. For example, since the height size of sample bottles varies, a user may need to adjust seat 814 upward or downward so that the top of the sample bottle (e.g., the pump spray) sits a usable distance above holder opening 808.

Figure 9:
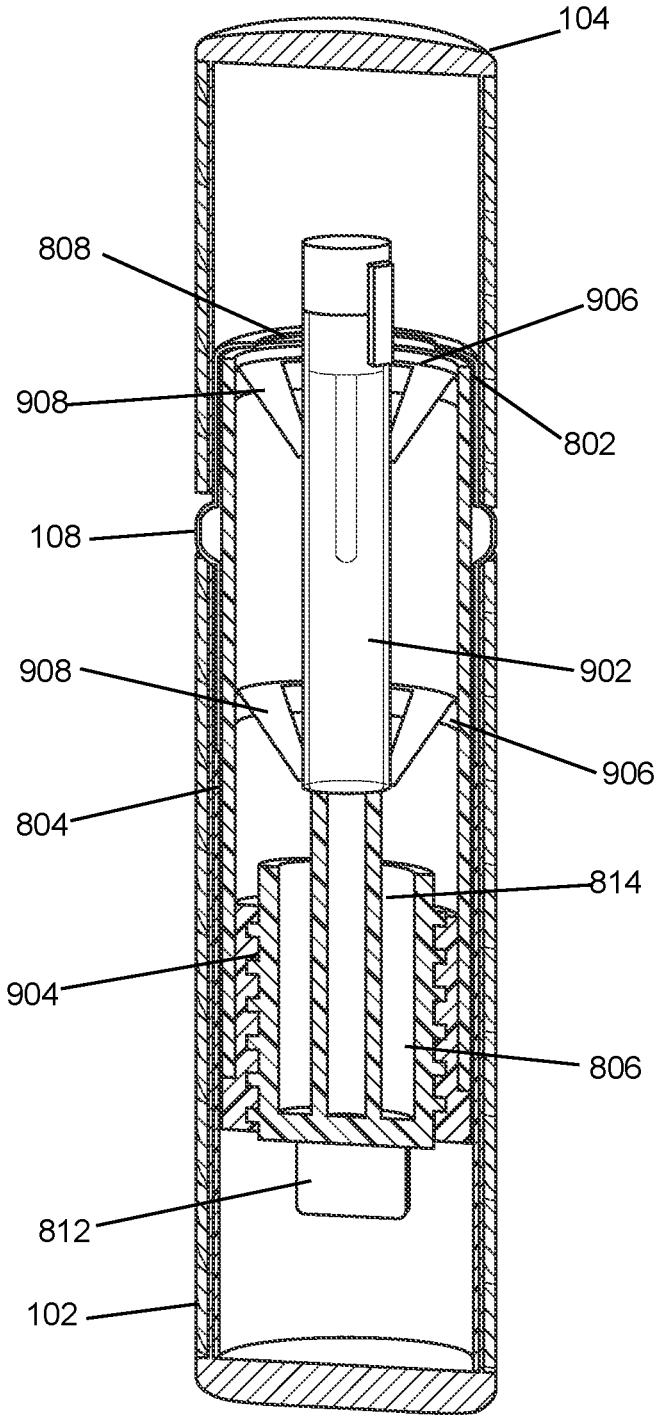
FIG. 9 depicts a cross-section view of the sample holder taken along plane A of FIG. 1 with a sample bottle inserted.

FIG. 9 depicts a perspective cross section view of the sample holder 100 of FIG. 1 taken along plane A. Here, a sample bottle 902 is shown placed in sample holder 100. Cap 104 covers the top of sample bottle 902 when not in use and prevents accidental discharge which may occur, especially when sample bottle 902 is a spray bottle actuated by pushing downward on the head of sample bottle 902. This figure also demonstrates how holder opening 808 helps to center sample bottle 902 within cylindrical tube 804.

Threads 810 of threaded seat 806 mate with grooves 904 internal to cylindrical tube 804. This allows a user to adjust seat 814 upward or downward within cylindrical tube 804 so that different length sample bottles 902 can be accommodate using a single sample holder 100.

Cylindrical tube 804 further comprises one or more internal gaskets 906 having a plurality of downward facing arms 908 arranged symmetrically in a ring pattern. From a top view, the arms 908 would appear to form a star pattern.

The center of the arms 908 forms an internal ring at the tip of the gasket 906 which is sized to be narrower than any current commercially available sample bottle 902. This internal ring is preferably 0.3-0.75 cm in diameter. Thus, when sample bottle 902 is inserted into cylindrical tube 804, the arms 908 are deflected downward and exert a spring retaining force on the exterior of sample bottle 902. The force exerted by arms 908 on sample bottle 902 prevent sample bottle 902 from becoming accidentally dislodged from sample holder 100. The use of arms 908 allows sample holder to be utilized with sample holders 902 having differing diameters because the arms 908 can be deflected. The only limit to the maximum width of the sample holder 902 is the width of holder opening 808. In order to remove sample bottle 902, a user must grasp the tip of sample bottle 902 and forcibly remove it.

Sample holder 100 preferably comprises at least two gaskets 906. However, it should be apparent than any number of gaskets can be employed. Gaskets 906, along with holder opening 808, provide three separate means for centering sample bottle 902 within cylindrical tube 804. Gaskets 906 and arms 908 are preferably formed from by molding polyethylene. This material provides reliably resiliency as sample holder 100 is used and sample bottles 902 are repeatedly replaced.

Figure 10:
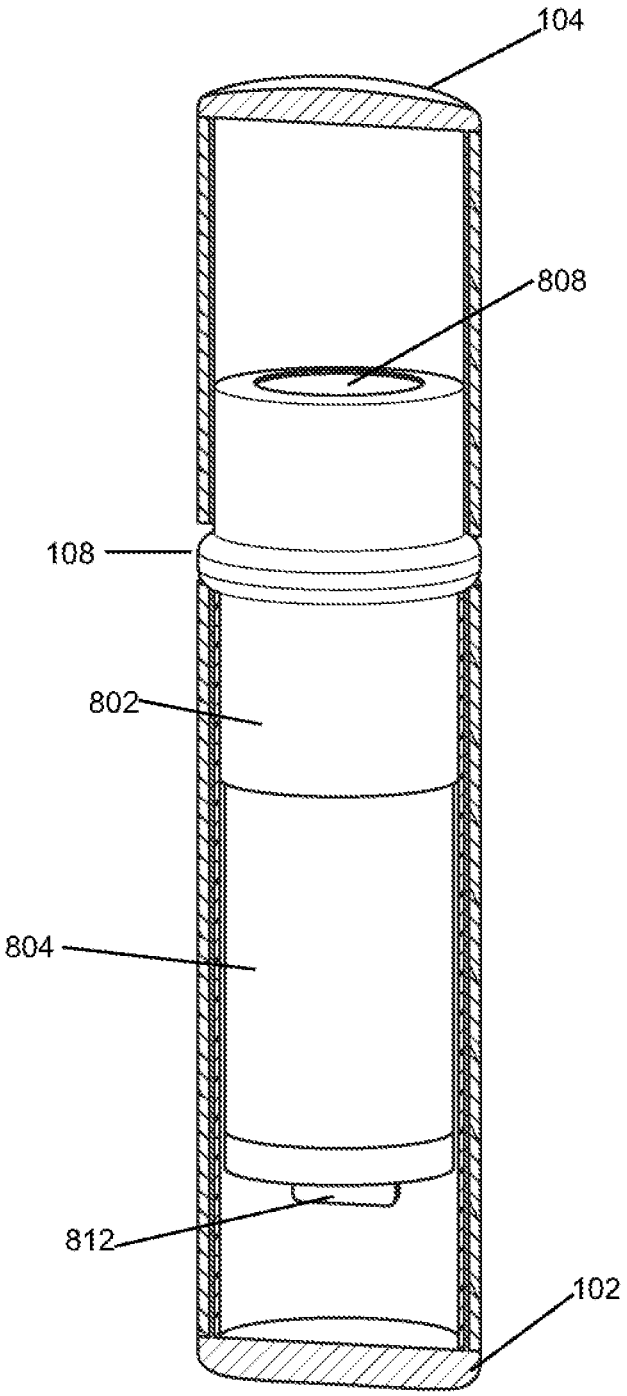
FIG. 10 depicts a perspective view of the sample holder with the outer body and cap shown cutaway to depict the interior elements.

FIG. 10 depicts a view of the assembled internal components of sample holder 100 with body 102 and cap 104 shown cutaway. Specifically, cap retainer 802 is fixed over cylindrical tube 804 and threaded seat 806 has been mated with cylindrical tube 804. In order to make use of sample holder 100, a user first removes cap 104 and pulls up on cap retainer 802 to remove the entire internal assembly from body 102. A user can then insert a sample bottle 902 into cylindrical tube 804 through holder opening 808. This causes arms 908 to spread and exert a spring retaining force on sample bottle 902. The user then uses handle 812 to adjust the height of seat 814 to accommodate the height of sample bottle 902 retained therein (e.g., from 4-5 cm in depth to the seat 814). Cylindrical tube 804 is then placed back into body 102 such that band 108 contacts a top of body 102. The user can then use sample bottle 902 for dispensing the liquid contained therein and use cap 104 to cover sample bottle 902 when needed.

Figure 11:
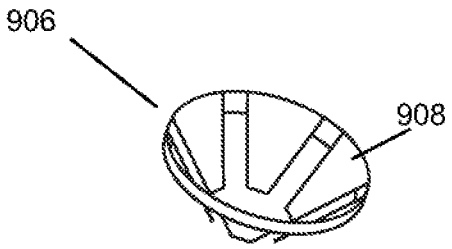
FIG. 11 depicts a perspective view of the gasket in isolation.

FIG. 11 depicts a single gasket 906 having six downward oriented arms 908. As can be seen here, the arms 908 deflect when a sample bottle is inserted and then return to their original shape when the sample bottle is removed. The arms 908 are preferably triangular in shape and have a flat/cut top to increase the contact area with the sample bottle.

The invention claimed is:

1. A sample holder comprising:

a cylindrical body having a closed bottom;

a cylindrical tube assembly releasably engaged with the cylindrical body, comprising a cylindrical tube configured for a friction fit with an interior of the cylindrical body; and a cap retainer extending from a top of the cylindrical tube, wherein at least a portion of the cap retainer has a band having a diameter greater than or equal to an inner diameter of the cylindrical body;

a holder opening in the cap retainer, wherein an inner diameter of the holder opening is less than an inner diameter of the cylindrical tube; and a plurality of circular gaskets arranged along a length of an interior of the cylindrical tube, wherein each circular gasket comprises:

a plurality of arms extending downward from an interior of the circular gasket, wherein the plurality of arms are configured to exert a spring retention force when a sample bottle is inserted into the sample holder; and a threaded seat comprising;

a seat configured to contact a bottom of the sample bottle when inserted into the sample holder;

a body having a plurality of exterior threads; and a handle, wherein the plurality of exterior threads are configured to mate with a plurality of helical grooves along an interior of an end of the cylindrical tube.

2. The sample holder according to claim 1, further comprising:

a cap configured to releasably mate with the cap retainer.

3. The sample holder according to claim 1, wherein turning of the handle causes the seat to linearly move along a central axis of the cylindrical tube.

4. The sample holder according to claim 1, further comprising:

an exterior cover for covering an outer periphery of the cylindrical body.

5. The sample holder according to claim 1, wherein the plurality of arms are integrally formed with the circular gasket.

6. The sample holder according to claim 5, wherein the plurality of circular gaskets are formed by molding.

7. The sample holder according to claim 6, wherein the plurality of arms are formed from polyethylene.

8. The sample holder according to claim 1, wherein the plurality of arms are a same size and a same shape.

9. The sample holder according to claim 1, wherein the plurality of arms are equally spaced.

10. A sample holder comprising:

a cylindrical body having a closed bottom;

a cylindrical tube assembly releasably engaged with the cylindrical body, comprising a cylindrical tube configured for a friction fit with an interior of the cylindrical body; and a cap retainer extending from a top of the cylindrical tube, wherein the cap retainer comprises a band having a diameter greater than or equal to an inner diameter of the cylindrical body;

a holder opening in the cap retainer; and a retaining structure having a plurality of arms extending inward and downward from an inner wall of the cylindrical tube for retaining a sample, wherein the plurality of arms taper in width away from the inner wall of the cylindrical tube; and a threaded seat comprising;

a seat configured to contact a bottom of the sample bottle when inserted into the sample holder;

a body having an exterior thread; and a handle, wherein the exterior thread is configured to mate with a helical groove along an interior of an end of the cylindrical tube.

11. The sample holder according to claim 10, wherein ends of the plurality of arms are arranged on a circle having a diameter less than a diameter of the holder opening.

* * * * *